United States Patent [19]

Hauver

[11] Patent Number: 4,660,921

[45] Date of Patent: Apr. 28, 1987

[54] SELF-TERMINATING COAXIAL CONNECTOR

[75] Inventor: Bruce C. Hauver, Elmira, N.Y.

[73] Assignee: LRC Electronics, Inc., Horseheads, N.Y.

[21] Appl. No.: 800,539

[22] Filed: Nov. 21, 1985

[51] Int. Cl.[4] ..... H01R 17/18

[52] U.S. Cl. ..... 339/177 R; 339/147 R; 339/42

[58] Field of Search ..... 339/177 R, 177 E, 147 R, 339/147 P, 42; 333/22 R, 260

[56] References Cited

U.S. PATENT DOCUMENTS

| | | | |
|---|---|---|---|
| 2,640,118 | 5/1953 | Werner | 333/22 R |
| 3,459,906 | 8/1969 | O'Keefe et al. | 200/51.1 |
| 3,525,056 | 8/1970 | Zurashi | 333/22 R |
| 3,784,950 | 1/1974 | Coffman | 333/22 R |
| 3,873,785 | 3/1975 | Lieberman | 333/260 |
| 3,996,534 | 12/1976 | Bacher | 333/260 |
| 4,575,694 | 3/1986 | Lapke et al. | 333/260 |

*Primary Examiner*—Eugene F. Desmond
*Assistant Examiner*—David Pirlot
*Attorney, Agent, or Firm*—Weingarten, Schurgin, Gagnebin & Hayes

[57] ABSTRACT

A self-terminating coaxial connector is provided which is adapted to versatile use in local area network, CATV and other coaxial cable systems. The connector has the external appearance of a conventional coaxial connector and has the structure for providing the self-terminating operation contained within the connector housing. A slidable assembly is disposed within the connector body and includes an electrical contact element having contact ends confronting respective ends of the connector. A second conductive element is attached to and electrically connected to the first contact element and includes one or more outwardly extending finger portions which confront one or more respective chip resistors which are supported in respective openings of the body. A spring is provided within the body and is operative to urge the slidable assembly to an outward position in the absence of a plug attached to the outlet end. In this outward position the finger portions are in electrical connection with the chip resistor to provide termination of the connector by providing a matched impedance between the contact element and the grounded connector body. With a plug installed onto the outlet of the body, the slidable assembly is urged inwardly of the body to cause the finger portions to move out of electrical engagement with the resistor, thereby breaking the connection to the terminating resistor when the connector is attached to an associated coaxial plug for use.

7 Claims, 4 Drawing Figures

SELF-TERMINATING COAXIAL CONNECTOR

FIELD OF THE INVENTION

This invention relates to coaxial connectors and more particularly to coaxial connectors which are electrically terminated in the absence of a coaxial plug connected thereto.

BACKGROUND OF THE INVENTION

Coaxial connectors are sometimes employed in systems where the connectors should be electrically terminated in the absence of a electrical connection to the connector to prevent an open circuit impedence mismatch which can adversely affect the performance of an associated system. Local area networks and cable television systems are such an application. In a cable television (CATV) system a coaxial transmission line has a plurality of outlet lines or drops tapped to the main transmission line for conveying television signals to subscribers. Each of the outlet or drop lines is connected to a coaxial connector to which the television receiver of a subscriber is connected. The coaxial connector serves as a subscriber outlet, and in the absence of a television receiver connected to the outlet, the connector is open circuited and provides an impedence mismatch which will cause signal reflections, with consequent degradation of the performance of the transmission network. It is beneficial to provide an impedence matched termination of unused outlets, and such matched terminations have been provided by manual connection of an impedence matched termination to unused outlets, or by automatically terminated outlets such as shown in U.S. Pat. Nos. 2,640,118; 3,459,906; and 3,525,056.

SUMMARY OF THE INVENTION

In accordance with the present invention a self-terminating coaxial connector is provided which is of improved construction and operation from known configurations and which is adapted to versatile use in local area network, CATV and other coaxial cable systems. The novel connector has the external appearance of a conventional coaxial connector and has the structure for providing the self-terminating operation contained within the connector housing. The connector housing has a threaded end to which a coaxial plug is threadably attached and typically includes a second threaded end to which a distribution cable is connected also by a coaxial plug. A slidable assembly is disposed within the connector body and includes an electrical contact element having contact ends confronting respective ends of the connector. A second conductive element is attached to and electrically connected to the first contact element and includes one or more outwardly extending finger portions which confront one or more respective chip resistors which are supported in respective openings of the body. A spring is provided within the body and is operative to urge the slidable assembly to an outward position in the absence of a plug attached to the outlet end. In this outward position the finger portions are in electrical connection with the chip resistor to provide termination of the connect or by providing a matched impedence between the contact element and the grounded connector body. With a plug installed onto the outlet of the body, the slidable assembly is urged inwardly of the body to cause the finger portions to move out of electrical engagement with the resistor, thereby breaking the connection to the terminating resistor when the connector is attached to an associated coaxial plug for use.

BRIEF DESCRIPTION OF THE DRAWINGS

The invention will be more fully understood from the following detailed description taken in conjunction with the accompanying drawings, in which.

DETAILED DESCRIPTION OF THE INVENTION

Figures 1, 2:
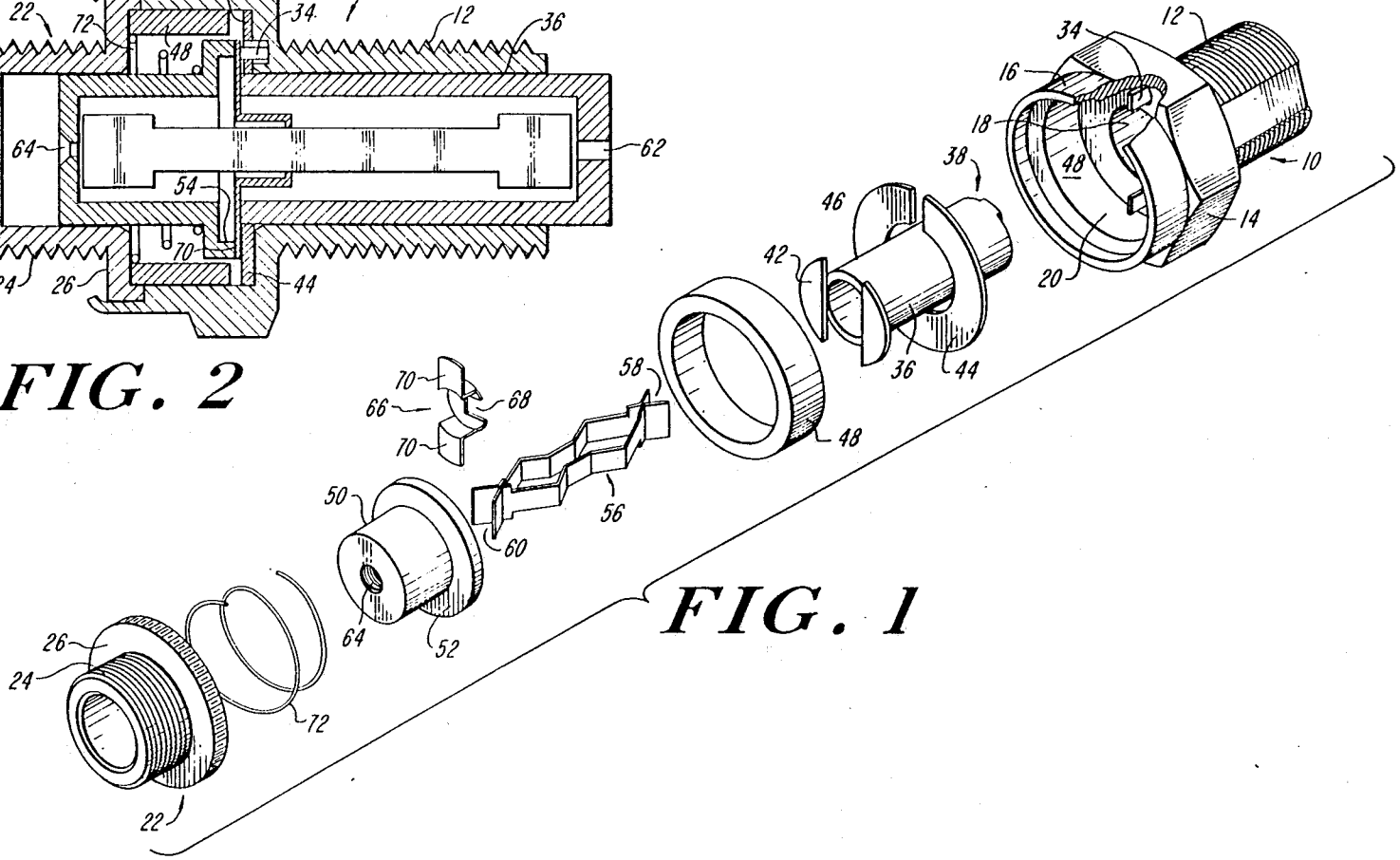
FIG. 1 is an exploded pictorial view of a coaxial connector in accordance with the invention.
FIG. 2 is a sectional elevation view of the coaxial connector in accordance with the invention and illustrated in its self-terminated position.
Figure 3:
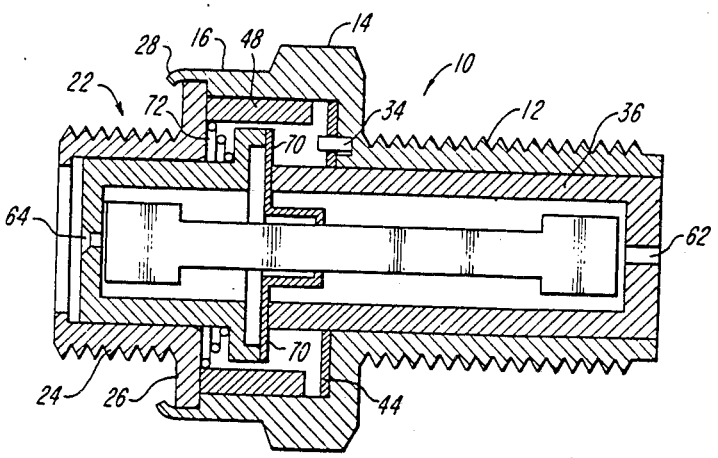
FIG. 3 is a sectional elevation view of the connector of FIG. 2 illustrated in its unterminated position.
Figure 4:
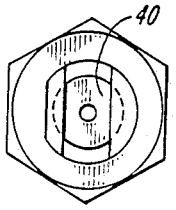
FIG. 4 is a end view of the outlet end of the connector.

A coaxial connector constructed and operative in accordance with the invention is shown in FIGS. 1–3 of the drawing. The connector comprises a body 10 having a threaded end 12, a central portion containing an integrally formed hex head 14 and an end portion 16. A cylindrical opening 18 is provided through the threaded portion and an enlarged opening 20 is provided in the central and end portions. A cap 22 has a threaded end 24 and a circumferential knurled flange 26 which is fitted within a cooperative bore in the end portion 16 of housing 10. The cap is affixed to and retained in the body 10 by the knurl and the edge 28 of the outer portion 16 which is bent inward around the confronting edge of the flange 26. The cap 22 includes a cylindrical opening 30 which is in alignment with the opening 18 through threaded end portion 12 of the body. The body 10 and cap 22 are formed of a metal or other conductive material, typically brass or aluminum. An opening 32 is provided in body 10 in the central portion thereof in a position adjacent to the opening 18. An electrical chip resistor 34 is installed in the opening 32, the chip resistor having an inner electrode end in electrical contact with the conductive body 10, and an outer electrode end confronting the enlarged recess 20.

A sleeve 36 of electrically insulative material is slidably disposed in opening 18 of body 10 and includes a key portion 38 cooperative with a key opening 40 in the outer end of threaded portion 12, and generally semicircular flange portions 42 at the inner end of the sleeve. A disc 44 of insulative material can be provided in the body 10, as illustrated, the disc having an opening 46 to fit over resistor 34. A ring 48 of electrically insulative material is fitted within the recess 20. An insulative element 50 has a cylindrical portion slidable within opening 30 of cap 22, and a flange portion 52 having a bore 54 into which the flanges 42 of sleeve 36 are fitted.

An electrical contact element 56 is formed as illustrated with confronting leaves and is disposed within sleeve 36 and insulator 50 with the respective contact ends 58 and 60 confronting the respective central openings 62 and 64 of sleeve 36 and insulator 50, respectively. A second conductive element 66 has a slotted central portion 68 which is fitted over and soldered or otherwise electrically connected to contact element 56. The contact element 66 includes outwardly extending finger portions 70 which are operative to selectively engage the confronting electrode of resistor 34. A coil spring 72 is disposed around insulator 50 and bears on flange 52 and flange 26, and in its normally expanded position, as illustrated in FIG. 2, provides a biasing force to urge the sleeve 36 to an extended position with the outer end of the sleeve extending beyond the threaded end of body 10. In this extended position, the insulator 50 is disposed inwardly of the body with finger portions 70 of contact element 66 in electrical engagement with the confronting electrode of resistor 34. The contact element 56 is thereby electrically connected to the terminating resistor 34 when the connector is in this rest position which occurs in the absence of a coaxial plug installed onto the threaded end 12 of the connector body.

With a plug installed onto the threaded end 172 of the body 10, the sleeve 36 is urged inwardly of the body by the force of the installed plug to cause the finger portion 70 to move out of electrical engagement with the resistor 34. As a result, the contact element 56 is not connected to the terminating resistor when the connector is connected to an associated coaxial plug for use. When a plug is connected to the body 10, the resistor 34 is open circuited, since the electrode end of the resistor is unconnected in this mode.

The body of the connector serves as the ground terminal of the cable circuit and the connector is thereby terminated by the resistor connected between the center conductor and ground to provide an impedance matched termination and to prevent an open circuit mismatch which, in the absence of the self-termination, could provide unwanted signal reflections and degradation of system performance.

The connector is typically attached to a mounting plate by insertion of the threaded end 12 through an opening of the mounting plate and securing the connector to the plate by a threaded nut. The mounting plate with attached connector is installed on a wall or other mounting surface of a subscriber premises, and the threaded end 24 is connected to the coaxial plug of the CATV cable drop. The threaded end 12 of the connector is in a position accessible for selective attachment of a coaxial plug of the subscriber television receiver cable. The connector need not have a threaded end 24, but can have an end termination of other forms to accommodate the particular coupling arrangement of the associated cable to be connected thereto. It will be appreciated that the novel self-terminating connector is not limited to use in a CATV distribution system, although it is of special benefit in such systems. The invention is useful for providing a self-terminating coaxial connector for many different coaxial cable systems.

The invention is not to be limited by what has been particularly shown and described, except as indicated in the appended claims.

What is claimed is:

1. A coaxial connector comprising:

a body of conductive material having a first end portion to which a coaxial plug is connectable, and a second end portion to which a coaxial plug is connectable;

a sleeve of electrically insulative material slidably disposed in the second end of the body and movable between an outer position and an inner position;

an electrical contact element disposed within the body and having contact ends confronting respective ends of the body for electrical connection to the center conductor of respective coaxial plugs;

a second contact element supported by and electrically connected to the first contact element;

the first contact element being disposed in the sleeve and movable therewith;

the second contact element having a finger portion which outwardly extends therefrom;

the body including a recess containing a resistor having one electrode in electrical contact with the body and a second electrode confronting the interior of the body, the finger portion of the second contact element confronting the second electrode of the resistor and selectively engagable therewith;

means within the body for biasing the sleeve into an outward position with an end of the sleeve extending axially outward of the second end of the body, the finger portion of the second contact element being in engagement with the second electrode of the resistor in this extended position to electrically terminate the first contact element;

the sleeve being slidably inward in the presence of a plug connected to the second end to cause movement of the finger portion out of contact with the second electrode of the resistor.

2. The connector of claim 1, wherein the biasing means includes a spring disposed within the body and operative to urge the sleeve and contact elements into the normally outward position.

3. The connect of claim 1, wherein the biasing means includes an insulative element having a cylindrical portion disposed within the first end of the body and a flange portion disposed in a central portion of the body, and having a bore therethrough;

a spring disposed around the insulative element and operative to bear against the flange portion to urge the sleeve into the outward position;

the first contact element having a portion disposed in the bore of the insulative element.

4. The connector of claim 1, wherein the body has a first section containing the first end portion, and a second section containing the second end portion and attached to the first section.

5. The connector of claim 4, wherein the body includes a central portion having an integrally formed hex head.

6. The connector of claim 4, wherein the body includes an opening therethrough, including a cylindrical portion through the second end portion and an enlarged opening in a central portion of the body, the first end portion of the body being part of the first section.

7. A coaxial connector, comprising:

a body having a first end portion to which a coaxial plug is connectable, and a second end portion connectable to a coaxial cable;

a slidable assembly within the body including a first electrical contact element movable in concert with the slidable assembly and having contact ends confronting respective ends of the body, the slidable assembly including sleeve means of electrically insulative material having a bore therethrough in which the first electrical contact element is disposed and having cylindrical portions slidable within respective end portions of the body; and a second contact element supported by and electrically connected to the first contact element and having at least one outwardly extending finger portion;

the body having at least one area containing a resistor having one electrode in electrical contact with the body and a second electrode confronting the interior of the body;

the finger portion of the second contact element confronting the second electrode of the resistor and selectively engageable therewith;

spring means within the body for biasing the slidable assembly into an outward position with an end of the slidable assembly extending outward of the first end of the body;

the slidable assembly in the outward position having the finger portion of the second contact element in electrical engagement with the second electrode of the resistor, and the slidable assembly in the inward position having the finger portion of the second contact element out of engagement with the second electrode of the resistor;

the slidable assembly being movable inward in the presence of the coaxial plug connected to the first end portion to cause movement of the finger portion out of engagement with the resistor.

* * * * *